United States Patent [19]

Rockwell

[11] Patent Number: 4,634,127

[45] Date of Patent: Jan. 6, 1987

[54] WALL MOUNTED EXERCISE UNIT

[75] Inventor: Gary L. Rockwell, LaGrange, Ga.

[73] Assignee: Diversified Products Corporation, Opelika, Ala.

[21] Appl. No.: 626,394

[22] Filed: Jun. 29, 1984

[51] Int. Cl.[4] ..... A63B 21/00

[52] U.S. Cl. ..... 272/134; 272/118; 272/143; 272/144; 297/118; 297/130

[58] Field of Search ..... 272/134, 118, 144, 130, 272/123, 143, 117, DIG. 4, 136, 142; 297/118, 130, 311, 316; 5/66

[56] References Cited

U.S. PATENT DOCUMENTS

| | | | |
|---|---|---|---|
| 1,902,694 | 2/1932 | Edwards | 272/134 |
| 2,855,199 | 10/1958 | Noland et al. | 272/134 X |
| 3,268,224 | 8/1966 | Freshour . | |
| 3,342,485 | 9/1967 | Gaul . | |
| 3,438,627 | 4/1969 | La Lanne . | |
| 3,625,511 | 12/1971 | Rennemann | 272/134 X |
| 3,635,472 | 1/1972 | Marcyan . | |
| 3,850,431 | 11/1974 | Winans | 272/118 |
| 4,072,309 | 2/1978 | Wilson | 272/123 X |
| 4,098,502 | 7/1978 | Faust | 272/144 |
| 4,183,520 | 1/1980 | Chase | 272/134 X |
| 4,199,139 | 4/1980 | Mahnke | 272/118 |
| 4,200,280 | 4/1980 | Goodwin | 272/118 |
| 4,358,108 | 11/1982 | Voris | 272/134 X |
| 4,369,966 | 1/1983 | Silberman . | |
| 4,396,191 | 8/1983 | Metler | 272/123 |
| 4,402,504 | 9/1983 | Christian | 272/DIG. 4 X |
| 4,431,184 | 2/1984 | Lew et al. | 272/118 X |
| 4,470,596 | 9/1984 | Desiderio | 272/118 |

FOREIGN PATENT DOCUMENTS

| | | | |
|---|---|---|---|
| 2335022 | 1/1975 | Fed. Rep. of Germany | 272/134 |
| 8202667 | 8/1982 | Int'l Pat. Institute | 272/118 |

OTHER PUBLICATIONS

Sorts Illustrated, Advertisement for "The Lean Machine", Feb. 1984.

*Primary Examiner*—Richard J. Apley
*Assistant Examiner*—Robert W. Bahr
*Attorney, Agent, or Firm*—Banner, Birch, McKie & Beckett

[57] ABSTRACT

A wall mounted exercise unit, particularly adapted for home or personal use. The exercise unit is readily stored in a folded position and includes an exercise bench which may be pivoted at an intermediate location to provide a wide range of exercise positions. Various accessory units may be readily incorporated into the exercise unit. The exercise unit may include a carriage assembly which allows the user to selectively exert a lifting force equal to either the full amount of weight set on the exercise unit, or only a portion of the weight set.

30 Claims, 19 Drawing Figures

101
106
107
108
114
116
118
120
121
122
123
124
125
126
127
128
129
130
130a
131
132
133
134
136
138
139
140
142
144
148

402
404
406
410
412
414
416
418
420
422
423
424
426
427
428
429
430
432
433
434
436
438
440
441
442
444
445
447
448
450
451
452
453
472

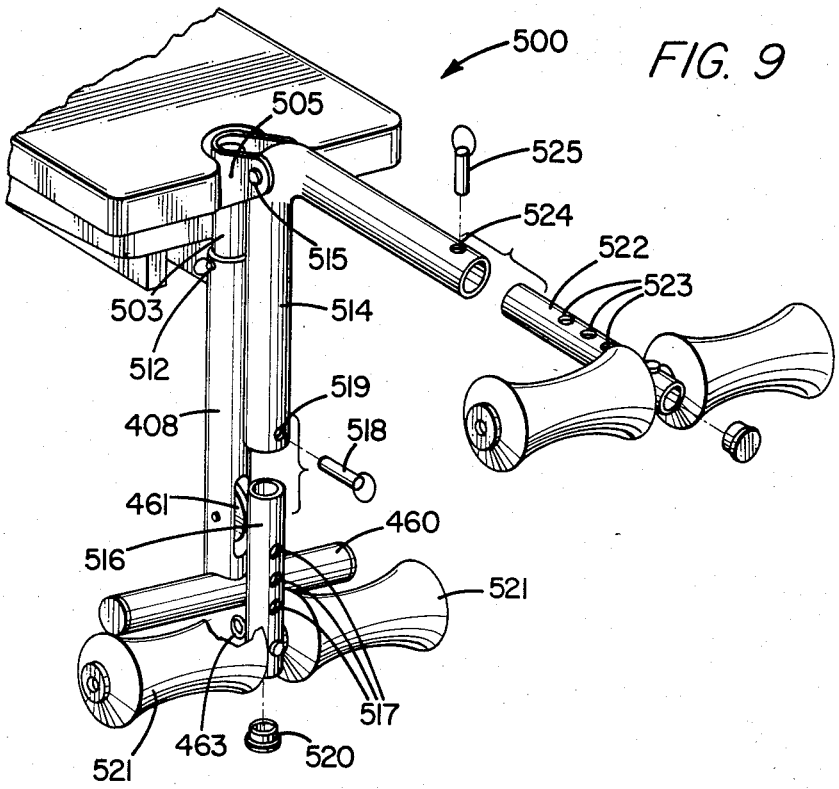
FIG. 9
FIG. 10
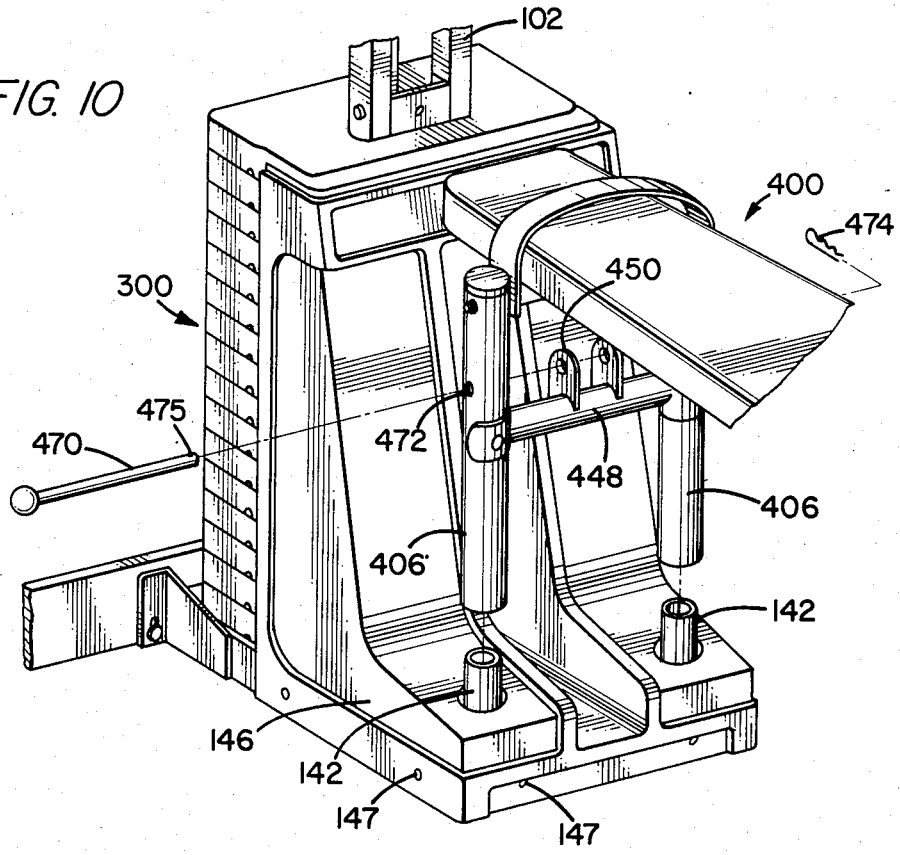

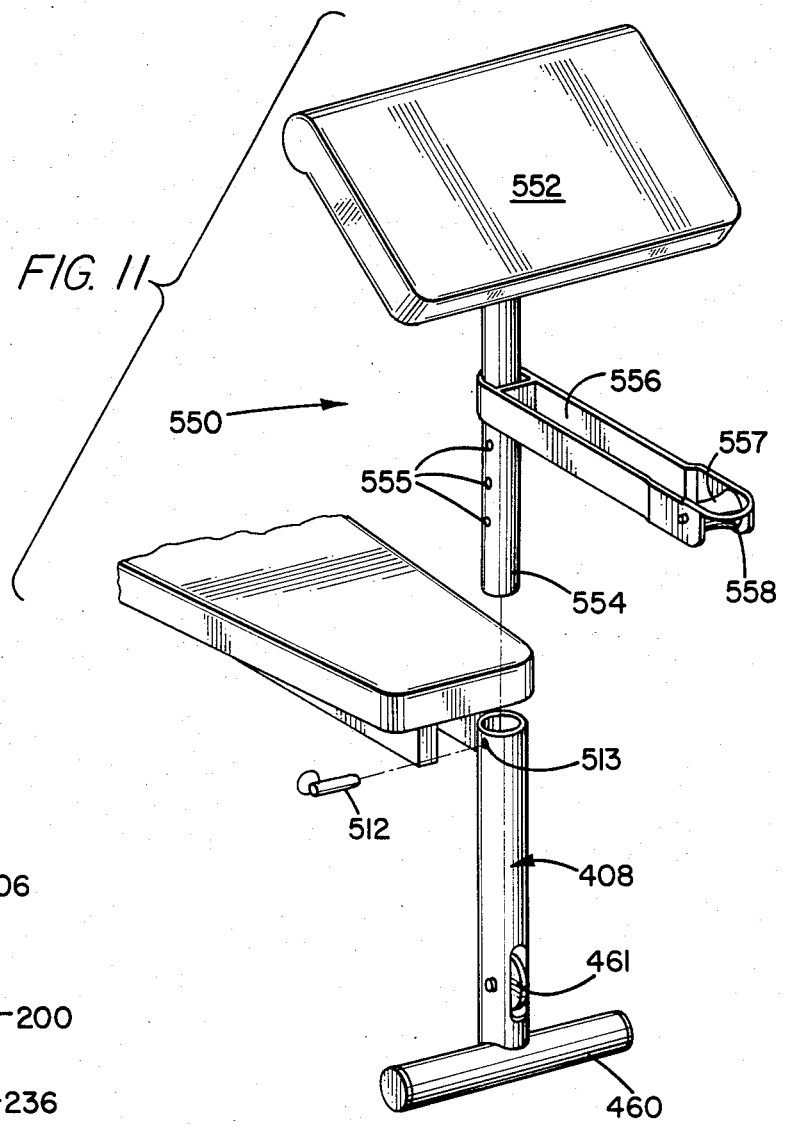
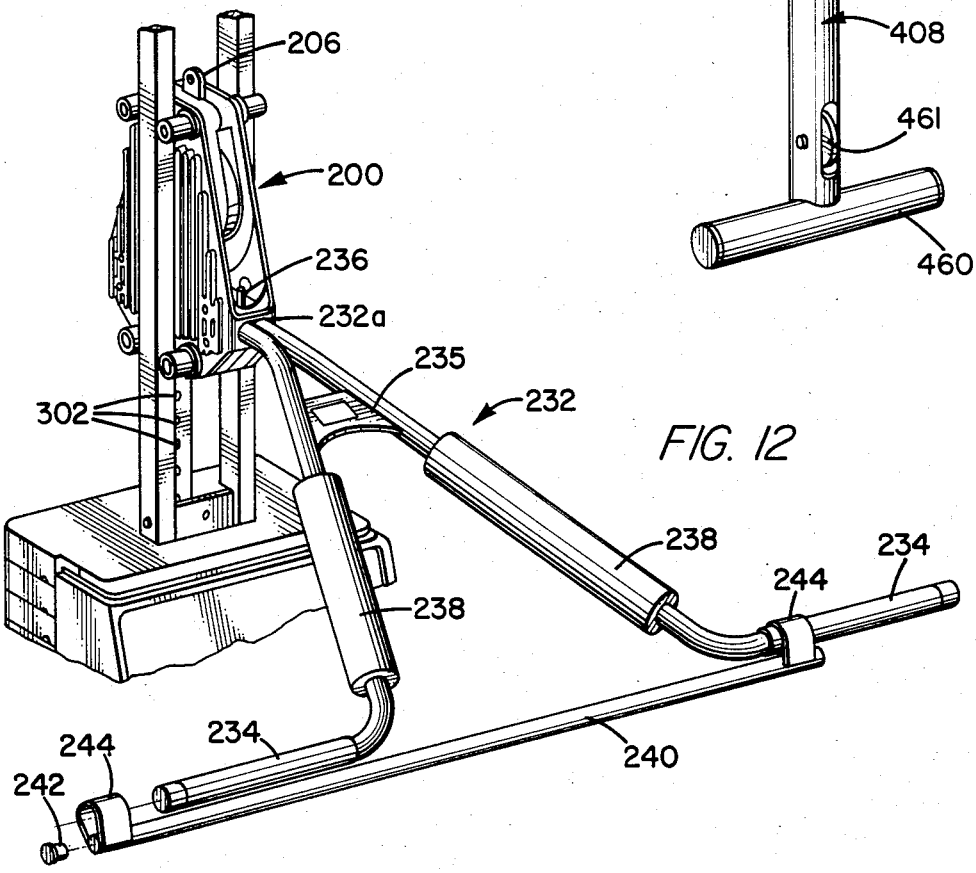
FIG. 12

WALL MOUNTED EXERCISE UNIT

BACKGROUND OF THE INVENTION

1. Field of the Invention

The present invention relates to exercise devices for developing and conditioning various parts of the body and, more particularly, to a weight lifting exercise unit.

2. Description of the Prior Art

The importance of regular exercise for building and maintaining strength and endurance cannot be overemphasized. The modern conveniences which we enjoy and the sedentary tasks which we increasingly perform have given us a comfortable life style at the expense of physical fitness. Highly active exercise programs, such as running, develop endurance of the cardiovascular system. Muscular strength and endurance is best developed through weight training.

The simplest and least expensive apparatus for weight training is the barbell with removable weights. However, the use of the barbell alone cannot develop all areas of the body. Hence, additional apparatus must be employed for a comprehensive conditioning program. Devices developed for this purpose generally provide the user with a force resister against which muscular effort must be applied. Resistance is typically provided by a weight and pulley arrangement, or by an elastic element. These devices permit the force to be applied to the user's body from many different directions in order to develop substantially all areas of the body.

Few of these weight training devices, however, can provide the user with substantially all of the exercising variants required to develop the entire body. Those that do are generally large, complex and costly machines which occupy a substantial amount of space, and consequently are not suitable for home or personal use. These are usually found only in health clubs and other athetic establishments. Devices specifically designed for home use, while somewhat smaller, have not provided the necessary and desired wide variety of exercise options. Hence, a need exists for a compact and versatile exercise unit which can be easily erected for use and easily stored. Particularly, home exercise units have not provided an adjustable floor supported exercise bench which was compact and readily adjustable to an incline or slant position. Additionally, in prior home exercise units incorporating a vertically guided weight and carriage assembly, the carriage assembly could not be selectively used to apply a lifting force to a cable equal to either the full amount of weight set on the exercise unit or only a portion of the weight set, thus providing a greater variety of weight options.

SUMMARY OF THE INVENTION

Accordingly, it is an object of the present invention to obviate the above noted disadvantages of the prior art by providing a simple, compact and inexpensive exercising apparatus for performing a complete range of weight training exercises.

Another object of the invention is to provide such an apparatus which is readily changed from its operative position to a compact storage position, and vice versa.

Another object of the invention is to provide such an apparatus which can be shipped in one or more packages of manageable size, and assembled by the consumer.

Another object of the invention is to provide such an apparatus which can be used to perform a full range of exercises in a minimum amount of space.

Another object of the invention is to provide such an apparatus which has a pivotable and adjustable bench assembly to facilitate placing the apparatus in its storage position and to provide for a wide variety of exercising positions.

Another object of the invention is to provide such an apparatus with a carriage and pulley assembly which can be selectively engaged to apply a lifting force equal to either the full amount of weight set on the exercise unit or only a portion of the weight set, thus providing a greater variety of weight options.

These and other objects of the present invention are accomplished by providing a novel exercise bench construction; the novel bench in combination with an upstanding the unit having at least one liftable weight, upright guide means for guiding the weight during lifting, and lifting means engagable by a user and operatively connected to the weight for raising and lowering the weight; an exercise unit of this type having a novel carriage/pulley arrangement; and a novel arm curl exercise unit.

The combined exercising apparatus of the present invention comprises an adjustable, floor-supported exercise bench fixed to the base of the exercise unit. The bench has an elongated frame, which supports a seat. Pivotable support means are provided adjacent the rear end of the bench for supporting the rear end of the bench frame above the floor. The pivotable support means also permits the bench to be readily pivoted between its storage and operative positions. At the front end of the bench is an adjustable second support means which supports the front end of the bench frame at a variable height above or adjacent the floor, and also accommodates a variety of exercise accessories.

The bench frame of the present invention comprises front and rear longitudinally arranged and pivotably interconnected subframes. The bench frame is thus able to pivot at an intermediate position so that the front subframe is at an angle with respect to the rear subframe. Front and rear cushions are respectively attached to the front and rear subframes.

A locking assembly is provided for preventing relative pivotal movement of the two subframes when the subframes are aligned in a mutually straight position. When the locking assembly is released, the subframes are free to pivot relative to one another so that the first subframe will be inclined with respect to the second subframe.

The carriage comprises a pulley wheel and a bracket member. By selectively fastening a carriage cable to the bracket member or threading the carriage cable through the pulley wheel, the lifting force applied will be equal to either the full weight set on the exercise device or a portion of the weight set.

BRIEF DESCRIPTION OF THE DRAWINGS

The novel features of the invention are set out with particularity in the appended claims, but the invention will be understood more fully and clearly from the following detailed description of the invention as set forth in the accompanying drawings, in which:

FIG. 9 is an exploded, perspective view of an auxiliary leg lift and leg curl assembly for the unit;

FIG. 10 is a partial perspective and exploded view of the base portion, weights, bench assembly and rear support of the exercise unit of the present invention;

FIG. 11 is an exploded, perspective view of an auxiliary exercise assembly for the unit;

FIG. 12 is a perspective view of the handlebar of the present invention with a leg press bar fixed thereto;

DETAILED DESCRIPTION OF THE PREFERRED EMBODIMENTS

Figure 1:
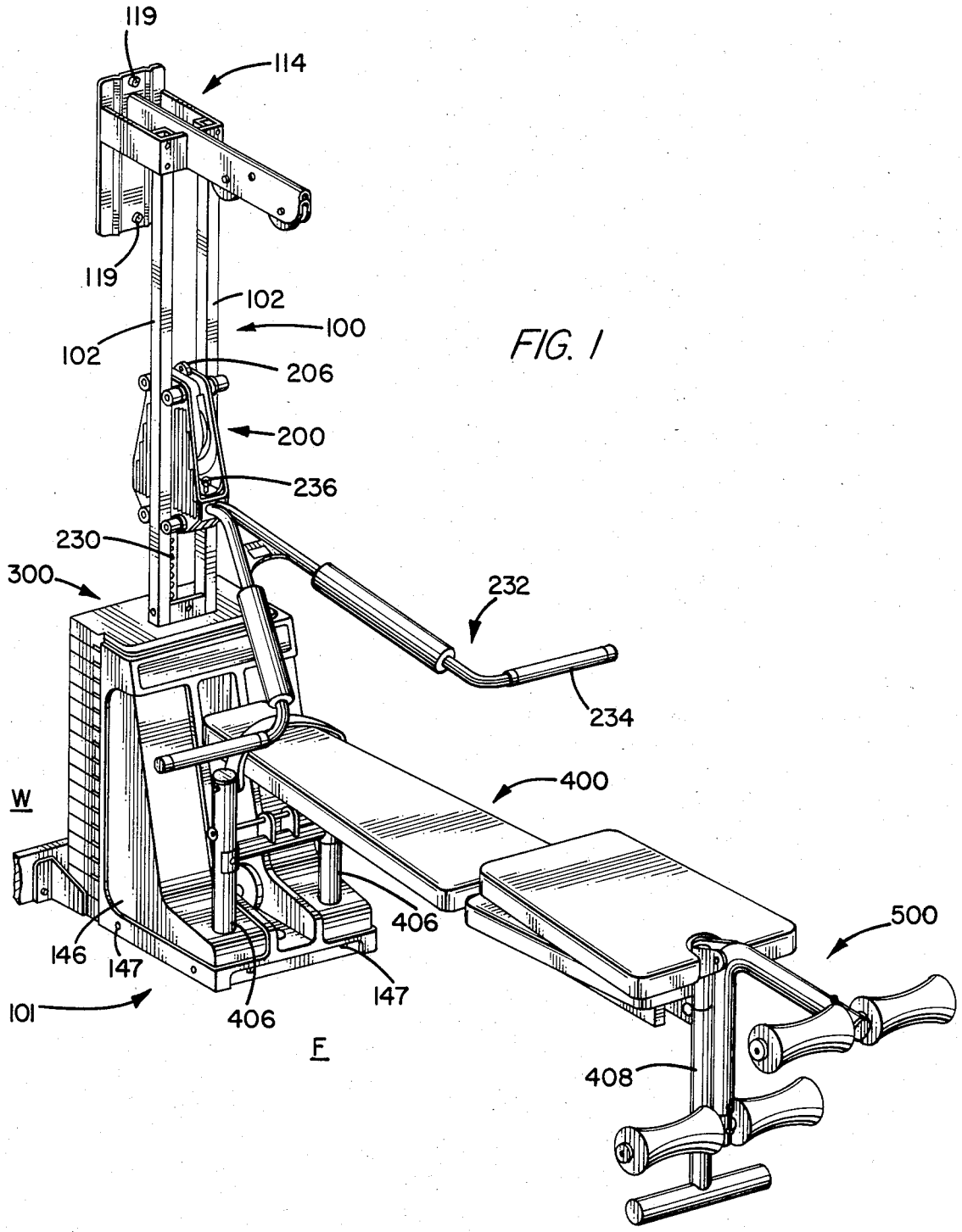
FIG. 1 is a perspective view of the exercise unit according to the invention.

Referring primarily to FIG. 1, the exercise unit of the invention generally comprises an upright guide bar frame 100 for guiding weights 300 lifted by a carriage and handle assembly 200, which is also guided along guide bar frame 100. Guide bar frame 100 is supported on a base 101, which rests on a floor F. Both guide bar frame 100 and base 101 are secured to a wall W or other vertical supporting surface at the top and bottom portions of the unit, as described in detail below. A bench assembly 400 may be attached to the exercise unit.

Guide bar frame 100 comprises two parallel guide bars 102 of generally square cross section fabricated in upper and lower guide bar portions 104 and 106, respectively. Fabrication of guide bars 102 in these shorter sections permits the unit to be packaged and shipped in one or more cartons of manageable size. Upper and lower guide bar sections 104 and 106 are joined together by a U-shaped spacer bracket 108 which spans the joints between the sections and is fastened to each of the sections by appropriate fastening means, such as bolts and nuts. These joints are reinforced by tubular inserts 107 which are received within guide bars sections 104 and 106 and are simultaneously fastened in place by the same appropriate fastening means.

Figures 3, 4:
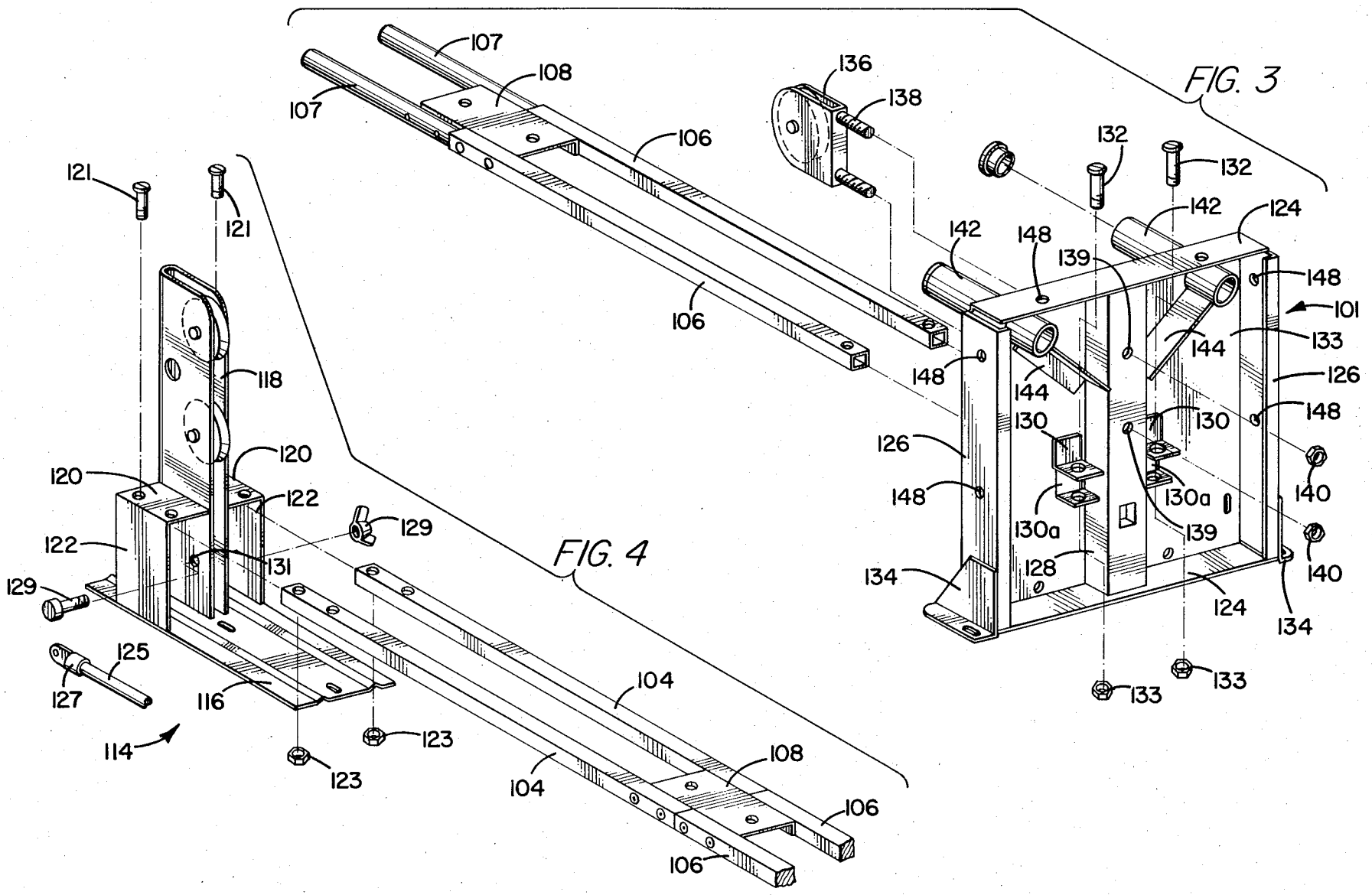
FIG. 3 is an exploded, perspective view of the base and lower portion of the guide means of the present invention.
FIG. 4 is an exploded, perspective view of the top support and upper portion of the guide means of the present invention.

The upper ends of guide bars 102 are secured to a top bracket 114 (FIG. 4). Bracket 114 has a back plate 116 and an integrally formed pulley assembly 118. Back plate 116 includes apertures through which appropriate fastening means, such as upper and lower hanger bolts 119, extend to secure the top of the unit to a wall (FIG. 1). Pulley assembly 118 projects forwardly from back plate 116 in a direction essentially perpendicular to the plane of back plate 116. Bracket 114 further includes a pair of apertured, transversely spaced flanges 120 to which guide bars 102 are bolted by bolts 121 and nuts 123. Flanges 120 are integrally connected to pulley assembly 118, as shown in FIG. 4. Bracket 114 also has flat portions 122 extending rearwardly from flanges 120. A cable 125 may be fixed to pulley assembly 118 to perform selected exercises. Apertured end 127 of cable 125 is fixed to pulley assembly 118 by a bolt and nut 129 extending through apertured end 127 and cable mounting hole 131 of assembly 118.

The bottom ends of guide bars 102 are fastened to base 101 (FIG. 3). Base 101 is formed from a flat base plate 133 having depending parallel flanges 124 and depending parallel flanges 126. A center support beam 128 is welded or otherwise integrally fixed to flanges 124 and base plate 133 midway between, and parallel to, flanges 126. A pair of apertured mounting flanges 130 are secured to base plate 133. The lower portion of guide bar portions 106 protrude through apertures **130*a* in base plate 133 and are bolted to mounting flanges 130 by appropriate fastening means, such as screws 132 and locknuts 133. Wall mounting brackets 134 are fixed to the outside of flanges 126 to enable base 101** to be fastened to a wall surface, as shown in FIG. 1.

A lower pulley bracket assembly 136 is fixed to support beam 128. Lower pulley bracket assembly 136 includes projecting threaded studs 138 which fit into holes in base plate 133 (not shown) and aligned holes 139 in support beam 128. Locknuts 140 are threaded onto studs 138 to secure lower pulley bracket assembly 136 to support beam 128. A pair of upwardly projecting guide posts 142 are secured to base plate 133 by L-brackets 144. L-brackets 144 are welded to guide posts 142, support beam 128 and base plate 133. As will be explained in detail below, the legs of a bench assembly may be placed over guide tubes 142 to secure a bench assembly to base 101 of the exercise unit.

A cover assembly 146 (FIG. 1) may be attached to flanges 124 and 126 by screws 147 or other appropriate fastening devices extending through apertures 148 in the flanges. Cover 146 may, for example, be a molded plastic cover.

Carriage assembly 200 (FIG. 5) comprises a pair of facing end plates 202. A pulley wheel 204 is rotatably supported between end plates 202 on an axle 205. An apertured bracket 206 is fixed between end plates 202 by a pin 207 extending through one of apertures 208 on bracket 206.

Figure 2:
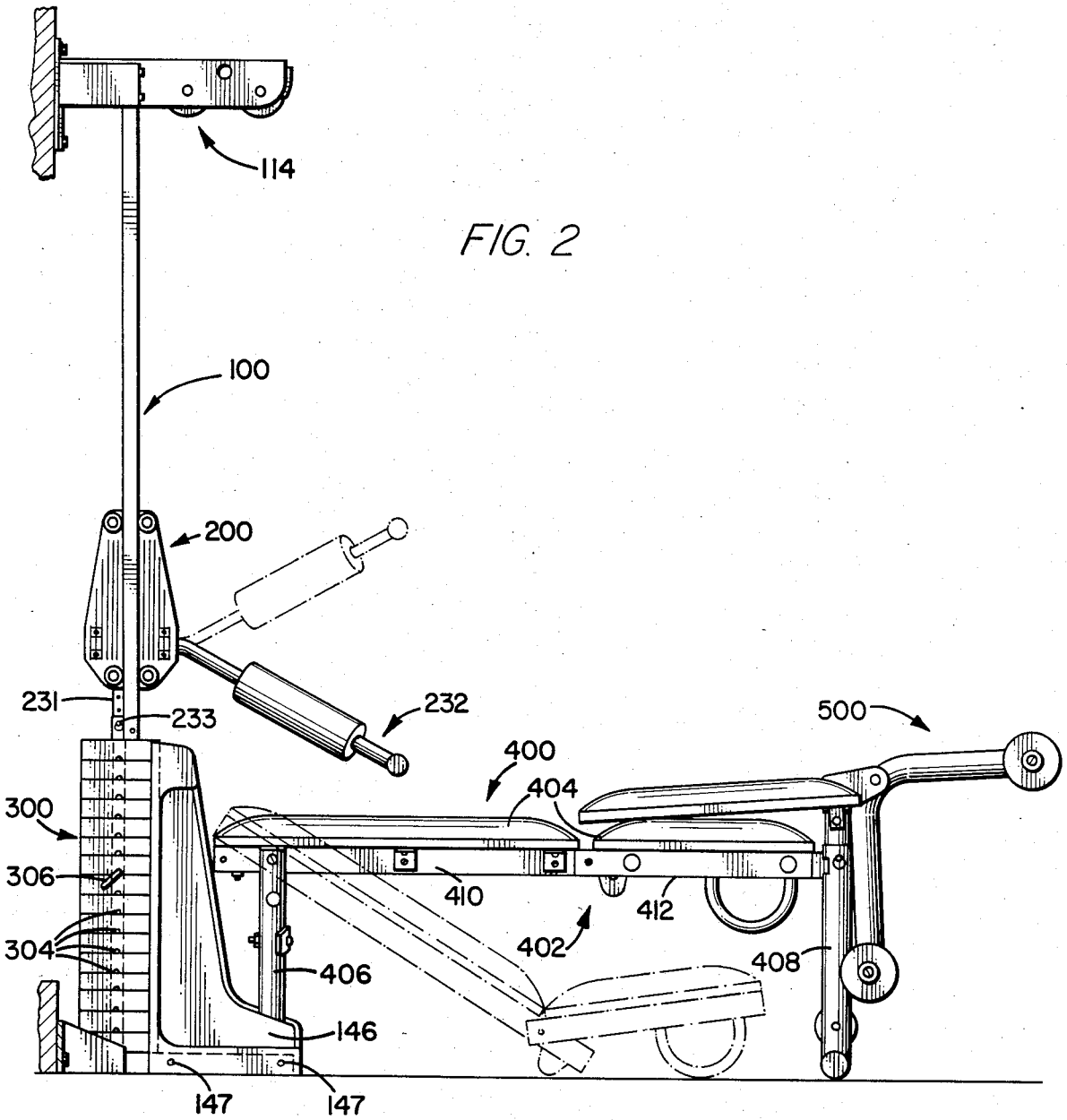
FIG. 2 is a side elevational view of the exercise unit.
Figure 5:
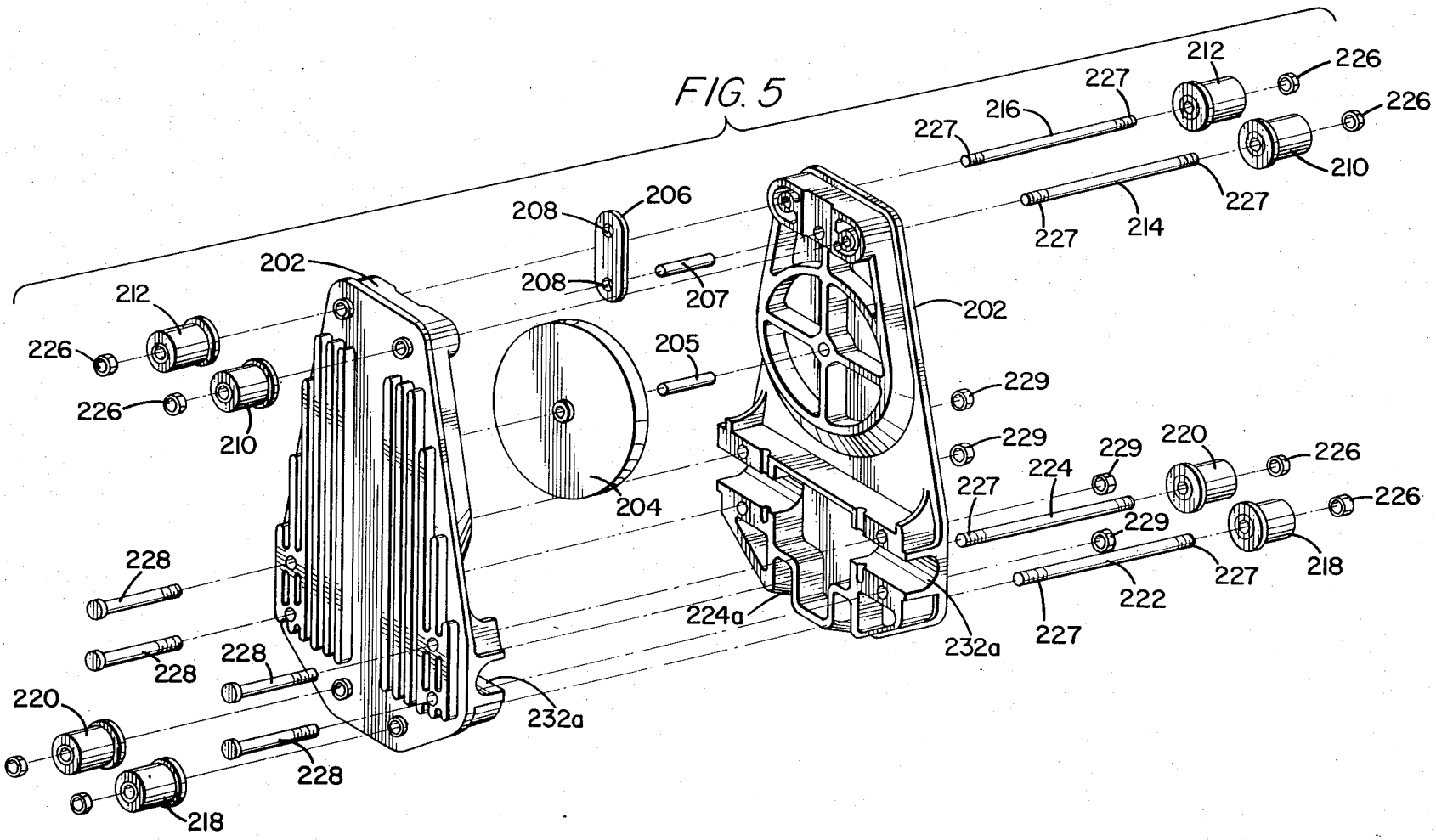
FIG. 5 is an exploded, perspective view of the carriage assembly of the present invention.

As shown in FIG. 5, two pairs of shouldered upper rollers 210, 212 are each rotatably journaled on the outside of the upper portion of carriage assembly 200 on axles 214, 216, respectively, which extend through end plates 202. Similarly, two pairs of shouldered lower rollers 218, 220 are each rotatably journaled on the outside of the lower portion of carriage assembly 200 on axles 222, 224, respectively, which extend through the end plates. Locknuts 226 secure rollers 210, 212, 218, and 220 onto threaded portions 227 of axles 214, 216, 222, and 224. End plates 202 are secured together by bolts 228 and locknuts 229, or other appropriate fastening means. As shown in FIGS. 1 and 2, the upper and lower pairs of rollers each engage the front and rear surfaces of guide bars 102.

Carriage 200 is adjustably fixed to an inner weight tube 230 (FIG. 1), which fits into an outer weight tube 231 (FIG. 2) within weights 300. Inner weight tube 230 is apertured at its upper end and is pinned in socket **224*a***

(FIG. 5) by axle 224. The inner and outer weight tubes each contain various vertically spaced apertures. By aligning a selected aperture on the inner weight tube with the top aperture on the outer weight tube, the height of cariage 200 on the exercise unit may be varied as necessary for doing different exercises. A pullpin 223 extends through the aligned apertures to secure the carriage at its selected height.

A handle 232 is atached to carriage 200 as shown particularly in FIG. 12. Handle 232 preferably comprises a generally Y-shaped member having outwardly directed grips 234. A brace 235 may be provided at the throat of the "Y" to reinforce the handle.

Handle 232 is inserted into socket 232*a* of carriage 200 as shown in FIG. 12. Peferably there are adjustment holes on the stem of the handle to allow the depth at which handle 232 is inserted into carriage 200 to be varied. A pullpin 236 secures handle 232 within socket 232*a* at its selected position.

In addition to varying the projection of handle 232 from carriage 200 and the height of the carriage on the exercise unit, the height of handle 232 is variable. Handle 232 may be installed in its lower position, shown in FIG. 1, for doing, for example, bench press exercises, or may be inverted and installed in its upper position, shown in dotted outline in FIG. 2, for doing, for example, military press exercises.

Y-shaped handle 232 is particularly suitable for exercises which require the user to be positioned between grips 234, such as squat or toe raise exercises. To provide added comfort, handle 232 may be provided with shoulder pads 238 which are adapted to rest on the user's shoulders when performing such exercises.

When performing certain exercises, such as a leg press, it is desirable to have a handle with a solid bar, i.e., one without the open neck of Y-shaped bar 232. To facilitate performing such exercises, a leg press bar 240 (FIG. 12) may be attached to grips 234 of handle 232. Leg press bar 240 is preferably a straight tubular bar closed by end caps 242. Guide tubes 244 are integrally fixed to bar 240. As shown in FIG. 12, bar 240 is rotatably fixed to grips 234 by guide tubes 244 which fit over each of grips 234. In operation, bar 240 is positioned so that it is essentially centered on grips 234. For performing, for example, a leg press exercise, bar 240 is positioned below grips 234 as shown in FIG. 12, and preferably to the inside of grips 234. For performing other exercises, such as close grip curls, bar 240 is rotated so that it is above grips 234.

Individual weights 300 are slid over guide bars 102 during assembly. Base plate 133 serves as a weight support platform. Weights 300 have a rectangular aperture in which guide bars 102 are received. Weights 300 also have a generally centrally located circular aperture adapted to receive weight tubes 230 and 231. Weight tubes 230 and 231 are provided with a series of vertically spaced, transverse holes 302 which are adapted to align with transverse bottom grooves 304 in each of weights 300. Selection of weight quantity is accomplished by positioning a pin or rod 306 through the groove 304 of the bottom one of a selected stack of weights and through the corresponding holes in weight tubes 230, 231. Hence, elevation of cariage 200 will raise weight tubes 230, 231, pin 340 and all weights supported thereabove.

If cable 125 is threaded through pulley wheel 204 as shown in FIGS. 15–17, and 19, a lifting force on the cable equal to only one-half of the weight 300 set on the exercise unit wll be required because of the mechanical advantage resulting from the pulley assembly. If cable 125 is fixed to bracket 206, a lifting force equal to the full amount of weight 300 will be required.

Figure 6:
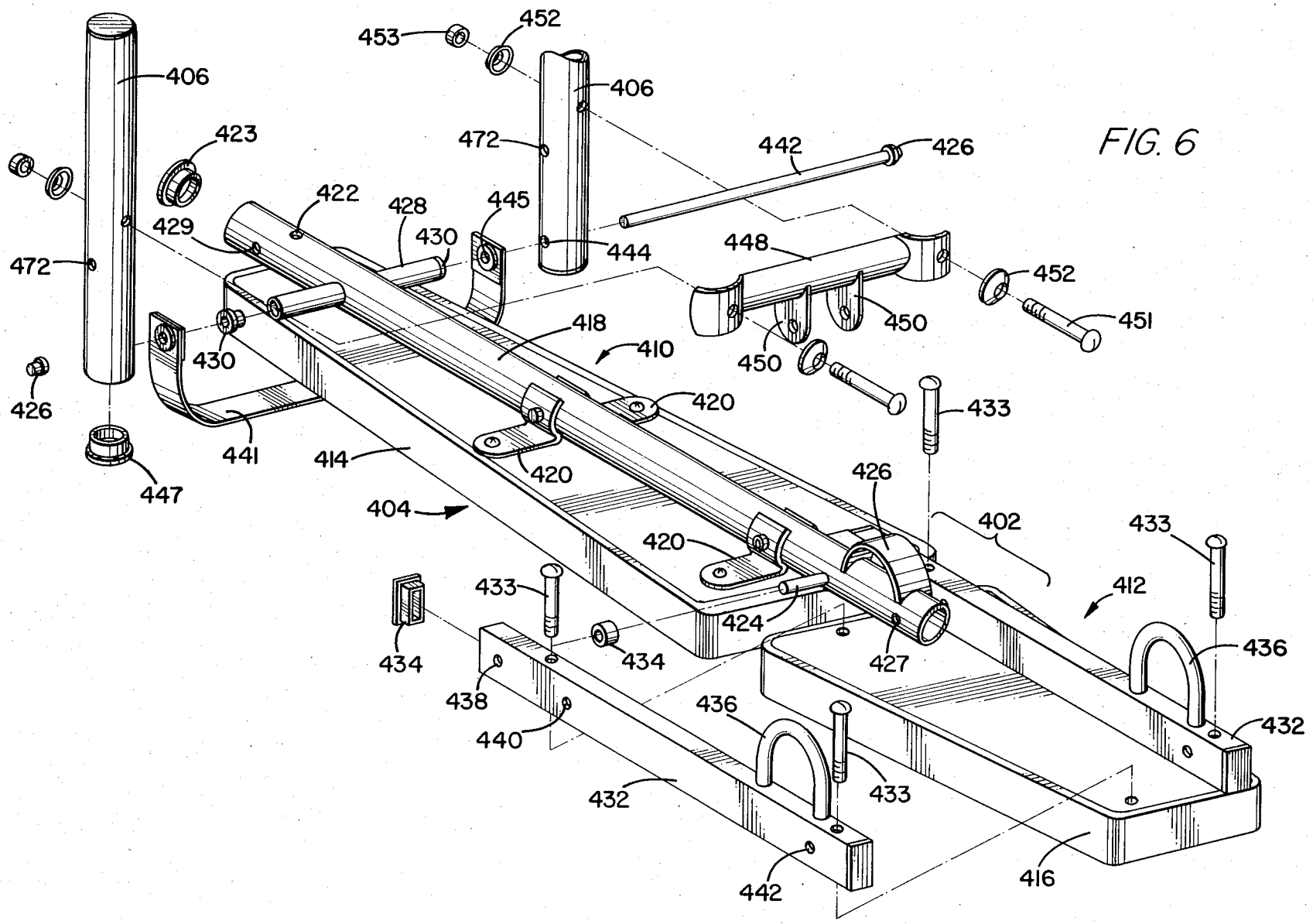
FIG. 6 is an exploded, perspective view of the bench assembly and rear support means of the invention, shown in an inverted position.

Referring to FIGS. 2 and 6, bench assembly 400 comprises an elongated frame, shown generally at 402, and a user support or cushion 404 fixed to frame 402. As shown particularly in FIG. 2, bench assembly 400 is adjustably supported on a floor by rear legs 406 and a removable front leg assembly 408.

Referring particularly to FIG. 6, elongated frame 402 includes a rear incline subframe 410 and a front or seat subframe 412. Similarly, cushion 404 is comprised of an incline cushion 414 and a seat cushion 416.

Incline subframe 410 comprises an undercarriage tube 418 which is fixed to the underside of incline cushion 414 by undercarriage brackets 420 and bolt 422. A tube plug 423 may be used to close off the open rear end of undercarriage tube 418. A pivot rod 424 extends transversely through undercarriage tube 418, near but spaced rearwardly from its front end. An incline foot 426, comprising a generally semi-circular support member, is integrally fixed to undercarriage tube 418 in front of pivot rod 424. A locking hole 427 is positioned in front of incline foot 426. A pivot tube 428 extends transversely through undercariage tube 418 near, but spaced forwardly from, its rear end. Bushings 430 are inserted into each open end of pivot tube 428. A storage hole 429 is provided at the rear end of undercarriage tube 418 for locking the bench assembly in its stored position, as explained below.

Seat subframe 412 comprises spaced seat cushion supports 432 fastened to the underside of seat cushion 416 by bolts 433 or other appropriate fastening means. Tube plugs 434 may be used to close the open ends of supports 432. A semi-circular or curved floor rod 436 is integrally fixed near the front end of each of supports 432. A pivot hole 438, a locking hole 440, and a front hole 442 extend transversely through each support 432.

Seat subframe 412 is assembled to incline subframe 410 by first placing a spacer element 434 over pivot rod 424 and then placing pivot rod 424 through pivot holes 438 of supports 432. In this configuration, seat subframe 412 can be pivoted with respect to incline subframe 410, as shown in dotted outline in FIG. 2.

Rear legs 406 and foot strap 441 are attached to incline subframe 410 by inserting a pivot axle 442 transversely through openings 444 in rear legs 406, through openings 445 in foot strap 440, and through pivot tube 428. A pushnut 446 is placed over each projecting end of axle 442 to thus secure the components in their assembled configuration. Appropriate tube plugs 447 may be placed in legs 406 to close their open upper ends.

A leg brace 448 having locking tabs 450 is fixed to the front side of rear legs 406 by bolts 451, washers 452 and locknuts 453. In this configuration, incline subframe 410 is rotatable about axle 442 and thus may be pivoted with respect to rear legs 406, as shown in dotted outline in FIG. 2 and in FIG. 13.

Figure 7:
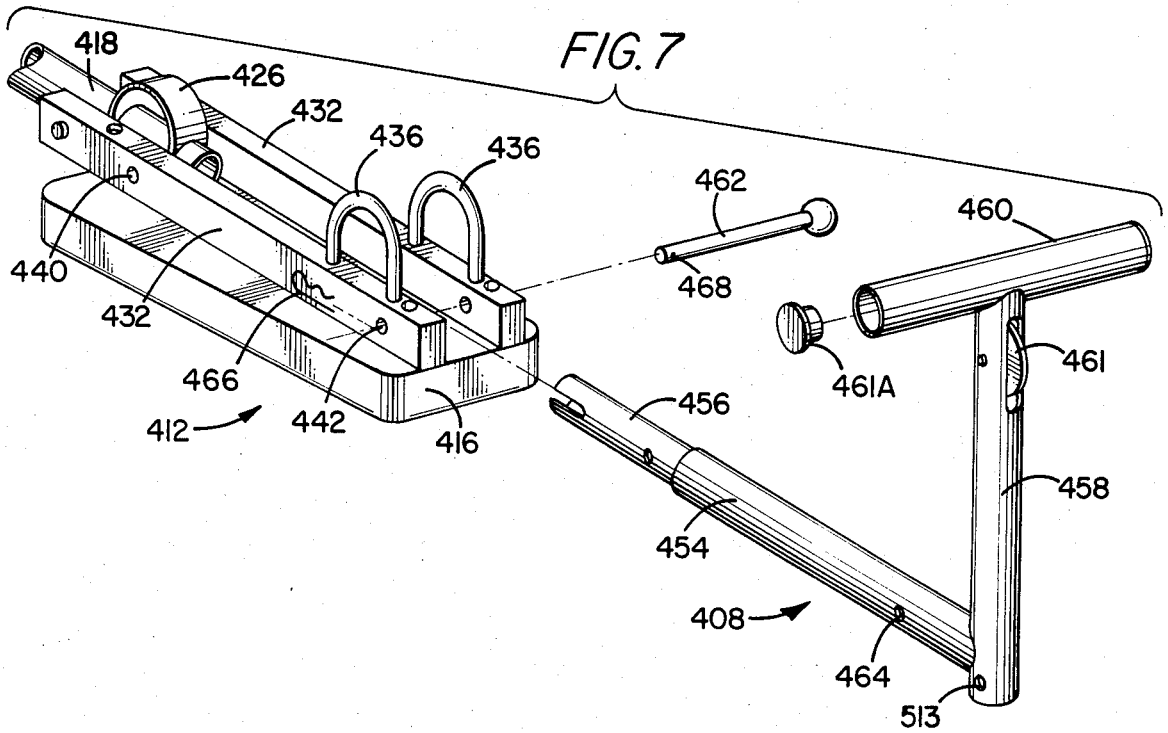
FIG. 7 is an exploded, perspective view of a portion of the bench assembly and support means of the present invention, shown in an inverted position.

In order to support the bench assembly at a level height above the floor, a removable front leg assembly 408 may be attached to seat subframe 412, as shown particularly in FIG. 7. Front leg assembly 408 comprises a first tube 454 which is inserted between seat subframe supports 432. Tube 454 includes a portion 456 of reduced diameter which is inserted into the open, front facing end of undercarriage tube 418. A second tube 458 is integrally connected to first tube 454 and is at right angles thereto. Floor tube 460 extends across second tube 458 in a T-shaped configuration. A pulley 461 is rotatably fixed in second tube 458. In operating position, floor tube 460 rests against a floor, as shown in FIGS. 1 and 2. The open ends of floor tube 460 may be closed by tube plugs 461A.

Front leg assembly 408 is fixed to seat subframe 412 by inserting a locking rod 462 transversely through aligned locking hole 464 of first tube 454 and front holes 442 of seat subframe supports 432. A hairpin cotter 466 is inserted through a hole 468 in the end of locking rod 462 to thus secure the front leg assembly in position. Front leg assembly may be easily removed from seat subframe 412 merely by removing hairpin cotter 466 and locking rod 462.

Bench assembly 400 may be connected to the exercise unit by sliding rear legs 406 over guide tubes 142, as shown particularly in FIG. 10. A locking rod 470 may extend through holes 472 in rear legs 406 and through locking tabs 450 on leg brace 448. A hairpin cotter 474 inserted through hole 475 in the end of locking rod 470 kiips locking rod 470 in position.

Figure 13:
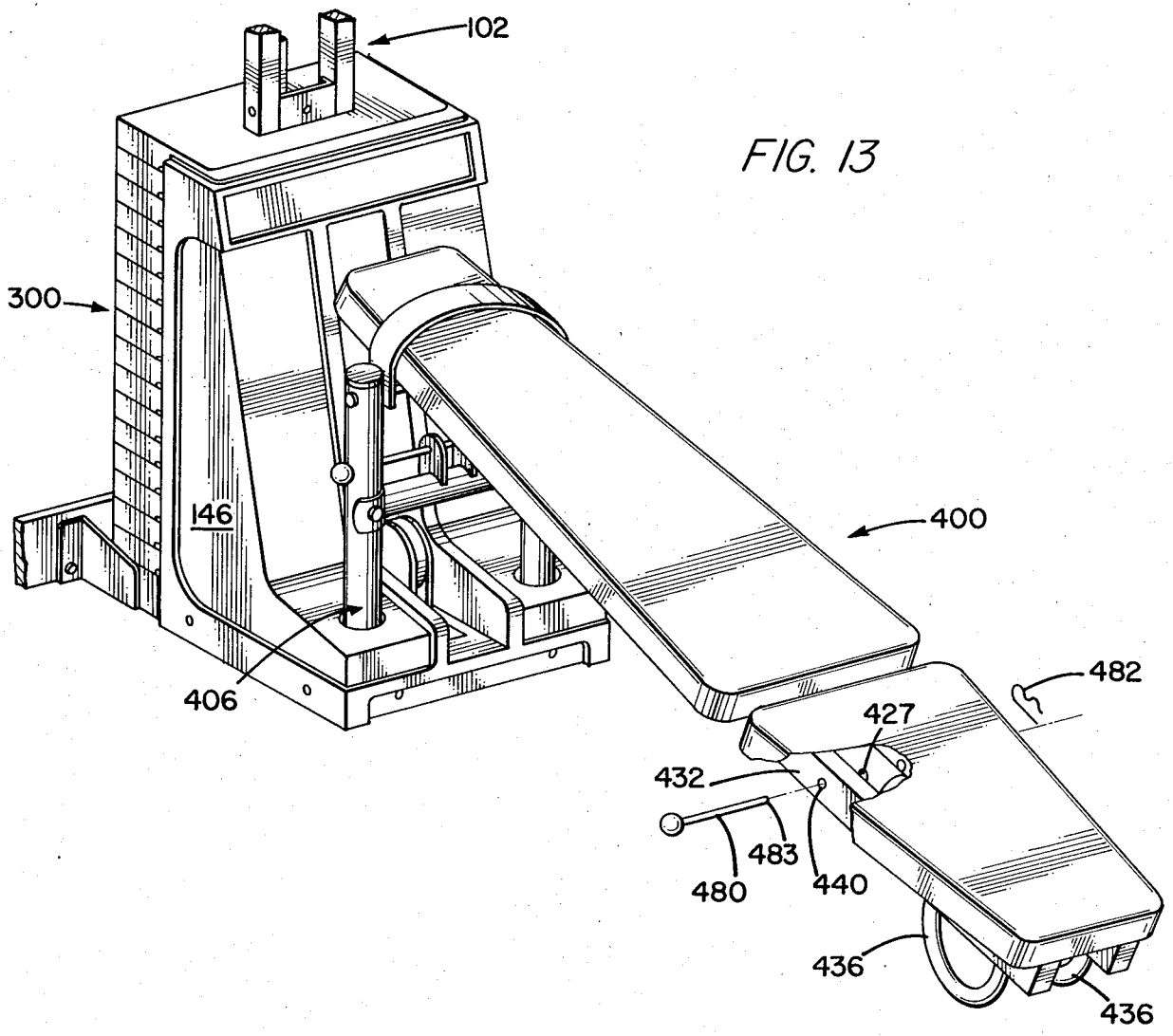
FIG. 13 is a perspective view of the lower portion of the exercise unit of the present invention with the bench in its slant board position.

Bench assembly 400 may be used as a slant board, as shown in FIG. 13. In order to be so used, front leg assembly 408 and any auxilary attachments, such as preacher curl assembly 550 or leg lift assembly 500, must be removed. A locking rod 480 is inserted through locking hole 440 of seat subframe supports 432 and through locking hole 427 of undercarriage tube 418. A hairpin cotter 482 extends through hole 483 in the end of locking rod 480 to secure the rod in place. In this configuration, seat subframe 412 is fixed in a mutally straight alignment with incline subframe 410 and is not able to pivot about pivot rod 424. Since front leg assembly 408 has been removed, the front of seat subframe 412 may be lowered until floor rods 436 engage the floor.

Bench assembly 400 alternatively may be positioned in an incline position, as shown in dotted outline in FIG. 2 by removing the locking rod 480, thus permitting seat subframe 412 to pivot about pivot rod 424. In this configuration, floor rods 436 and incline foot 426 engage the floor to support the bench in its incline position.

Figure 8:
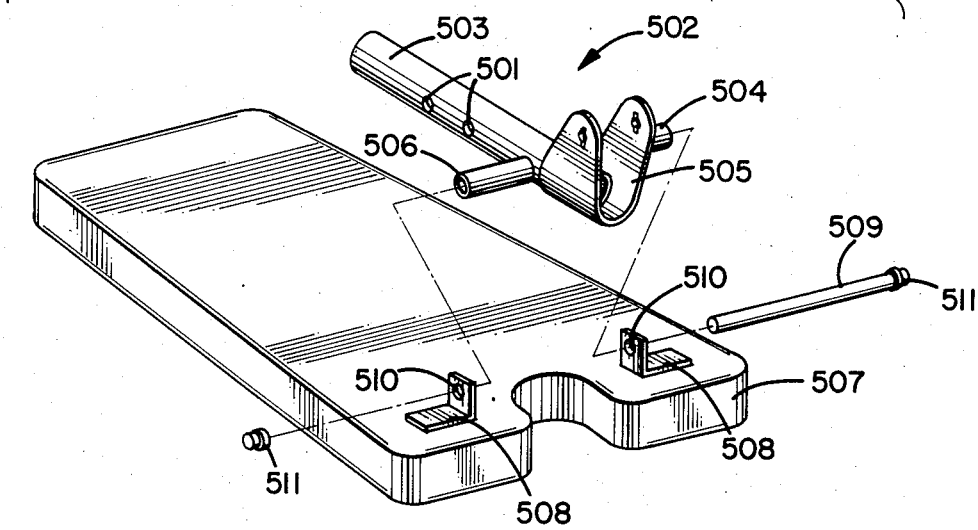
FIG. 8 is an exploded, perspective view of an auxiliary leg lift cushion and pivot assembly for the unit.

A leg lift assembly 500 may be connected to front leg assembly 408, as shown particularly in FIGS. 8 and 9. Leg lift assembly 500 comprises a leg lift pivot unit 502, which comprises a main tube 503, a pivot tube or rod 504 extending transversely through tube 503, and a pivot bracket 505 fixed to main tube 503. Bushings 506 are inserted into each end of pivot tube 504. Main tube 503 preferably has a plurality of adjustment holes 501 for adjusting the height of pivot unit 502 in its assembled configuration as explained below.

A leg lift cushion 507 is attached to leg lift pivot unit 502, as shown particularly in FIG. 8. Leg lift cushion 507 includes mounting brackets 508 on its bottom or underside. Pivot tube 504 is placed between brackets 508. A pivot rod 509 extends through openings 510 in brackets 508 and through pivot tube 504. Pushnuts 511 cap each end of pivot rod 509 to secure it in its assembled position.

Main tube 503 of leg lift pivot unit 2 is inserted into front leg assembly 408, as shown paticularly in FIG. 9. A pullpin 512 is inserted through one of holes 501 in main tube 503 and a corresponding hole 513 (FIG. 7) in front leg assembly 408 to secure tube 503 in its assembled position.

An L-shaped leg lift tube 514 is attached to leg lift pivot unit 502 by pivot pin 515 inserted through leg lift tube 514 and connecting leg lift tube 514 to pivot bracket 505, as shown particularly in FIG. 9.

As shown, when thus assembled, one leg of tube 514 projects downwardly, with the other leg projecting perpendicular thereto in a forward direction. A foot extension tube 516 may be connected to the downwardly projecting tube of leg lift tube 514. Foot extension tube includes various adjusting holes 517 which enable it to be adjustably positioned in leg lift tube 514 using a pullpin 518 inserted through a hole 519 in leg lift tube 514 and one of the adjusting holes 517 in foot extension tube 516. A tube plug 520 may be used to close the open end of foot extension tube 512. Foot extension tube 512 includes foot pads 521 which are to be engaged by the user's ankle area when performing a leg lift exercise. Foot pads 521 are spool-shaped with a reduced diameter center portion.

A leg curl extension tube 522, generally similar to foot extension tube 516, may be inserted into the forwardly projecting leg of leg lift tube 514, as shown generally in FIG. 9. Leg curl tube 522 includes adjusting holes 523 which enable leg curl tube 520 to be adjustably positioned within leg lift tube 514. One of adjusting holes 523 is aligned with an aperture 524 in leg lift tube 514 and secured in position by a pullpin 525 inserted through the aligned apertures.

Figure 15:
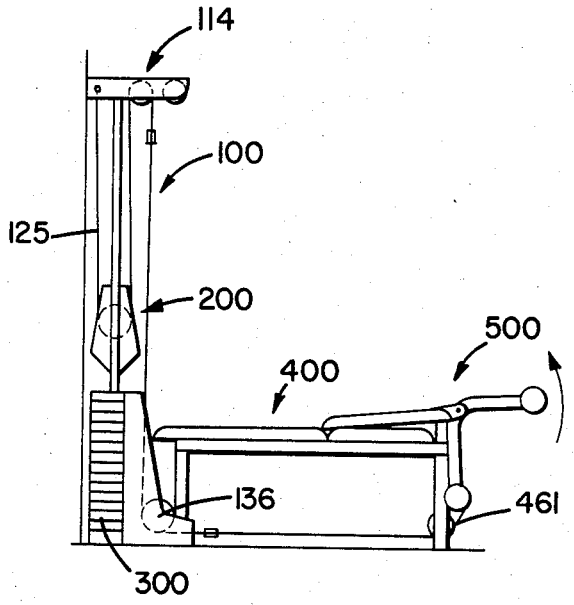
FIGS. 15–19 are schematic, side elevational views of the exercise unit configured for some of the many exercises for which the unit may be used.

Leg lift assembly 500 is used with cable 125. One end of cable 125 is pinned to bracket 114 by bolt 129 fixed through hole 131, as shown in FIG. 4. Cable 125 is then threaded under pulley wheel 204, over a pulley wheel in pulley assembly 118, under lower pulley bracket assembly 136, under pulley wheel 461, and fixed to an eyelet 463 in foot extension tube 516, as shown in FIG. 15. In this configuration, a lifting force equal to one-half of the weight 300 set on the unit will be exerted by the user.

Alternatively, rather than securing leg lift assembly 500 in front leg assembly 408 as described above, a "preacher curl" assembly 550, primarily for doing arm curl exercises, may be connected to front leg assembly 408, as shown generally in FIG. 11. Preacher curl assembly 550 includes a preacher curl cushion 552 which is connected to a preacher curl support tube 554. Support tube 554 includes a plurality of adjusting holes 555, which may be selectively aligned with aperture 513 of front leg 408 to fasten preacher curl assembly 550 at a desired height in front leg assembly 408. Pullpin 512 secures preacher curl assembly 550 in its selected position. A preacher curl cable arm 556 is connected to support 554 and extends perpendicular thereto in a forward direction, as shown in FIG. 11. Preacher curl cable arm 556 includes a roller 557 and a cable guide or retainer 558. Preacher curl cable arm 556 guides and facilitates movement of a cable attached to weights 300 when doing a preacher curl exercise.

Figure 16:
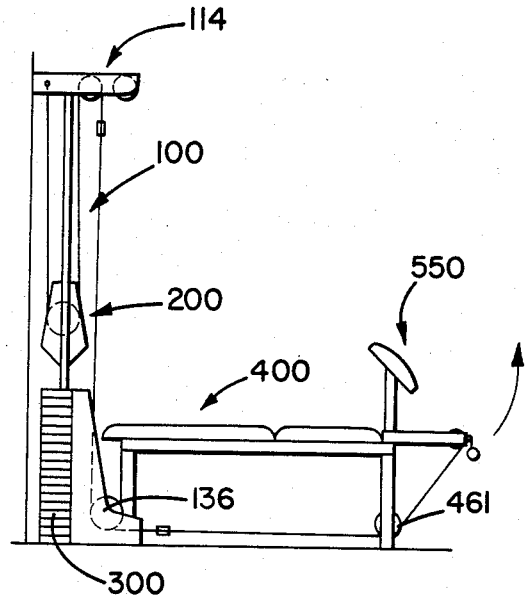

Preacher curl assembly 550 is used with a preacher curl cable threaded through the pulley wheels of the unit in a manner similar to the configuration previously described with respect to leg lift unit 500. However, when using preacher curl assembly 550, the cable may not be threaded through pulley wheel 204, but rather may be connected directly to bracket 206, in which configuration a lifting force equal to the full amount of weight 300 is applied. Alternatively, the preacher curl assembly may be configured as shown in FIG. 16, using pulley wheel 206, in which configuration a lifting force equal to one-half of weight 300 is applied.

Figure 14:
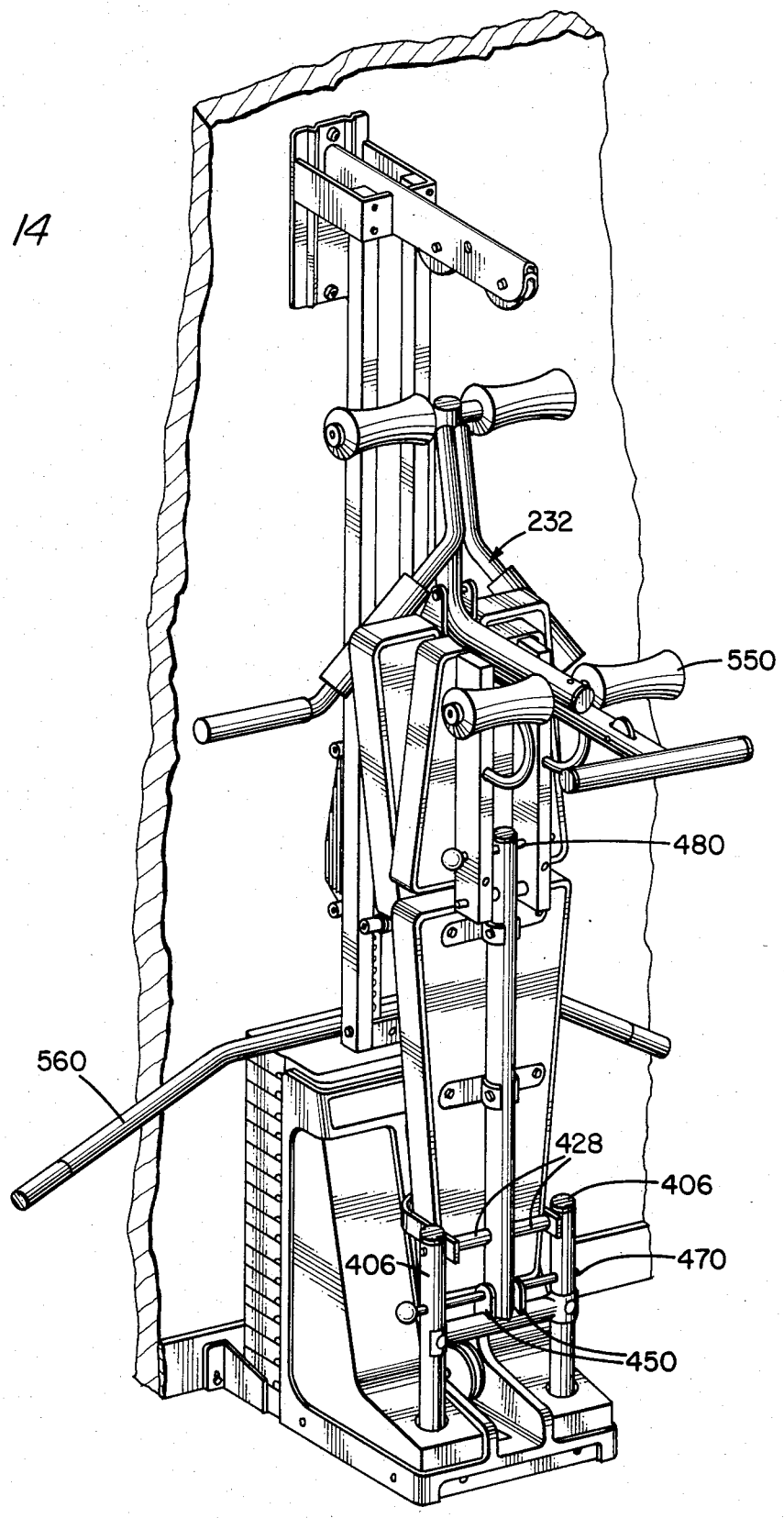
FIG. 14 is a perspective view of the exercise unit of the invention shown in its stored position.

The exercise unit may be conveniently placed in a storage position, as shown in FIG. 14. In order to place the exercise unit in its storage position, any accessories such as leg lift assembly 500 or preacher curl assembly 550, as well as handle 232 and front leg assembly 406 should be removed from the assembly to provide a more compact storage position. However, as shown in FIG. 14, leg lift assembly 500 has been left in position, and handle 232 has been hung in a convenient location. A lat bar 560 also has been hung in a convenient location. In the storage position, seat subframe 412 is placed in its locked, mutually straight position with respect to incline subframe 410 by inserting locking rod 480 through locking holes 440 and 427. Locking rod 470 (FIG. 10) is removed and bench assembly 400 is pivoted about pivot tube 428 until bench assembly 400 extends essentially in a vertical direction. In this position, storage hole 429 (FIG. 6) is aligned with apertures in locking tabs 450. Locking rod 470 is then reinserted through holes 472 in rear legs 406, through storage hole 429, and through apertures in locking tabs 450 to thus lock bench assembly 400 in its folded, storage position.

Figure 17:
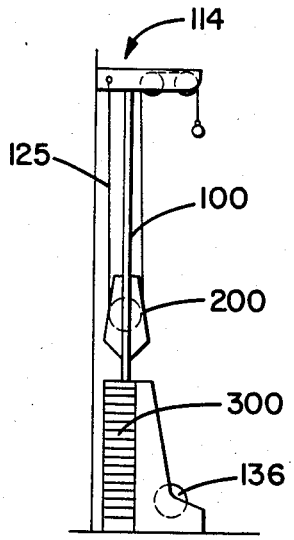
Figure 18:
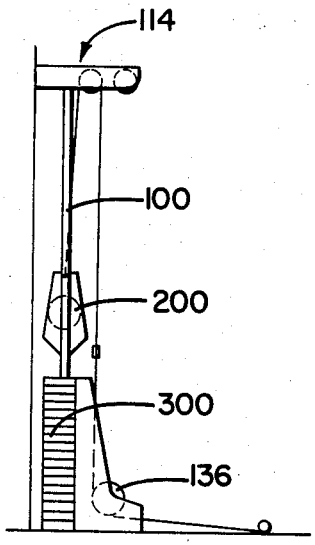
Figure 19:
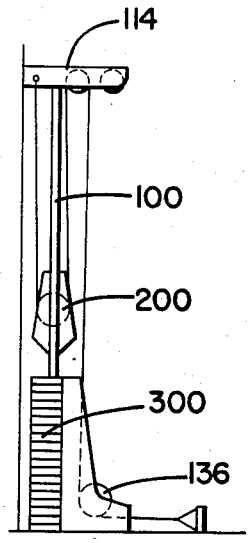

Various types of exercises may be performed with the cable and pulley system and accessories of the present invention by selectively threading cable 125 through the aforementioned pulleys and cable guides. For example, FIG. 17 illustrates the carriage cable assembly for performing various "high pull" weight lifting exercises. Any suitable handle or grip may be secured to the cable to facilitate performing these exercises. FIGS. 18 and 19 illustrate alternative cable arrangements for performing various "low pull" exercises. In FIG. 19, a suitable handle or grip is shown attached to the end of the cable. In FIG. 18, a lifting force equal to the full amount of weight 300 is applied; in FIG. 19, a lifting force equal to one-half of weight 300 is applied.

It will be appreciated that the exercise unit of the invention successfully accomplishes its objectives by virtue of its simplicity, versatility, and compactness when folded for storage. It is capable of many varied uses for exercising substantially all portions of the body.

Although preferred embodiments have been described, it will be obvious to one of ordinary skill that numerous modifications may be made without departing from the true spirit and scope of the invention, which is to be limited only by the appended claims.

I claim:

1. In an adjustable, floor-supported exercise bench having an elongated bench frame, a seat supported on said bench frame, and front and rear support means for supporting said frame above the floor, the improvement comprising:

said bench frame having front and rear longitudinally arranged subframes, said subframes each having front and rear ends, the rear end of said front subframe positioned adjacent the front end of said rear subframe with the rear end of said rear subframe supported by said rear support means, said rear subframe comprising a single, tubular, longitudinal undercarriage member;

pivot means for pivotably interconnecting the adjacent ends of said subframes;

said front support means comprising a front leg assembly selectively coupled with said undercarriage member for selectively supporting said front subframe between (1) a first position wherein said front leg assembly is removed from said undercarriage assembly so that said front subframe and said front end of rear subframe are adjacent the floor and wherein said rear subframe is supported by said undercarriage member so that said rear subframe is inclined upwardly at an obtuse angle with respect to said front subframe when said front and rear subframes are in said first position and (2) a second position wherein said front leg is coupled with said undercarriage member and wherein said front and rear subframes are substantially coplanar and elevated above the floor; and lock means for selectively allowing relative pivotal movement about said pivot means between said subframes in said first position and selectively preventing relative pivotal movement about said pivot means between said subframes in said second position.

2. An exercise bench as recited in claim 1 wherein said seat comprises front and rear seat cushions attached to said front and rear subframes, respectively.

3. An exercise bench as recited in claim 1 wherein said front subframe comprises a pair of spaced, longitudinal support members, and floor engaging members fixed adjacent to the front end of each of said support members for supporting said front subframe adjacent the floor when said front subframe is selectively positioned adjacent a floor.

4. An exercise bench as recited in claim 1 wherein said rear support means is attached to a user-engageable force resister unit.

5. An exercise bench as recited in claim 4 wherein said user-enageable force register unit comprises a liftable, guided weight assembly, pulley means, a user-engageable cable operatively coupled to said weight assembly and said pulley means, and effort level selection means for selectively varying the mechanical advantage of said cable and pulley means so as to require a lifting force equal to either the full amount of the selected weight or a portion of the selected weight.

6. An exercise bench as recited in claim 5 wherein said weight assembly includes a guided carriage and at least one weight attached thereto, said pulley means comprises a carriage pulley movable with said carriage and an upper pulley at a fixed location above said carriage, and said effort level selection means comprises cable coupling and anchoring means for coupling one end of said cable directly to said carriage with said cable trained over said upper pulley for requiring a lifting force equal to the selection weight and for anchoring said one end of said cable at an elevated location with said cable trained around said carriage pulley and said upper pulley for halving the required lifting force.

7. An exercise bench as recited in claim 1 further comprising a leg exercise assembly, said leg exercise assembly including:

a pivot unit removably supported on said front support means;

a leg exercise cushion fixed to said pivot unit and overlying said front seat cushion; and a user-engageable leg exercise member pivotably attached to said pivot unit for pivotal movement longitudinally of said bench.

8. An exercise bench as recited in claim 1 wherein said leg exercise assembly comprises adjustment means for adjusting the height thereof relative to said front subframe.

9. An exercise bench as recited in claim 7 wherein said user-engageable leg exercise member comprises a leg lift arm which pivotally depends from said pivot unit and has ankle engaging means at the distal end thereof.

10. An exercise bench as recited in claim 7 wherein said user-engageable leg exercise member comprises a leg curl arm which pivotally extends forwardly from said pivot and has ankle engaging means at the distal end thereof.

11. An exercise bench as recited in claim 7 wherein said user-engageable leg exercise member comprises a generally L-shaped member which is pivotally attached to said pivot unit and has a depending leg lift arm, a forwardly extending leg curl arm, and ankle engaging means at the distal ends of each of said arms.

12. An exercise bench as recited in claim 1 further comprising an arm curl exercise assembly removebly supported adjacent the front end of said front subframe, said arm curl exercise assembly including:

a support member removably supported on said front support means;

a forwardly facing and inclined arm curl cushion fixed to said support member; and cable guide means including a forwardly projecting guide arm fixed to said support member, and a cable guide adjacent the forward end of said guide arm for guiding a user-engageable tensioned cable.

13. An exercise bench as recited in claim 12 wherein said arm curl exercise assembly comprises adjustment means for adjusting the height thereof relative to said front subframe.

14. An exercise bench as recited in claim 12 wherein said cable guide comprises a roller rotatably supported by said guide arm, and a cable retainer fixed to said guide arm and extending forwardly of said roller to define therewith a captive guideway for said cable.

15. In an exercise unit including an upright guided weight assembly having at least one liftable means engageable by a user and operatively connected to said weight for raising and lowering said weight, and a forwardly extending bench having front and rear support means, the improvement comprising:

said bench frame having front and rear longitudinally arranged subframes, said subframes each having front and rear ends, the rear end of said front subframe positioned adjacent the front end of said rear subframe;

said rear support means being anchored to said upright weight assembly and the rear end of said rear subframe being pivotably connected to said rear support means at a predetermined position above the floor;

said rear subframe comprising a single, tubular, longitudinal undercarriage member;

pivot means for pivotably interconnecting the adjacent ends of said subframes;

said front support means comprising a front leg assembly selectively coupled or uncoupled with said undercarriage member for selectively supporting said front subframe between (1) a first position wherein said front leg assembly is removed from said undercarriage assembly so that said front subframe and said front end of said rear subframe are adjacent the floor and wherein said rear subframe is supported by said undercarriage member so that said rear subframe is inclined upwardly at an obtuse angle with respect to said front subframe when said front and rear subframes are in said first position and (2) a second position wherein said front leg assembly is coupled with said undercarriage member and wherein said front and rear subframes are substantially coplanar and elevated above the floor; and lock means for selectively allowing relative pivot movement about said pivot means between said subframes in said first position and selectively preventing relative pivotal movement about said pivot means between said subframes in said second position.

16. An exercise unit as recited in claim 15 wherein said front subframe comprises a pair of spaced, longitudinal support members, and floor engaging members fixed adjacent to the front end of each of said support members for supporting said front subframe adjacent the floor when said front subframe is selectively positioned adjacent a floor.

17. An exercise unit as recited in claim 15 further comprising an arm curl exercise assembly, said arm curl exercise assembly comprising:

a support member removably supported on said front support means;

a forwardly facing and inclined arm curl cushion fixed to said support member; and cable guide means including a forwardly projecting guide arm fixed to said support member, and a cable guide adjacent the forward end of said guide arm for guiding a user-engageable tensioned cable.

18. An exercise unit as recited in claim 15 wherein said undercarriage member and said front leg assembly are fixed in a mutually straight position by said lock means when selected to prevent pivotal movement about said pivot means.

19. An exercise bench as recited in claim 18 further comprising a leg exercise assembly, said leg exercise assembly comprising:

a pivot unit removably supported on said front support means;

a leg exercise cushion fixed to said pivot unit and overlying said front seat cushion; and a user-engageable leg exercise member pivotably attached to said pivot unit for pivotal movement longitudinally of said bench.

20. An exercise unit as recited in claim 19 wherein said leg exercise assembly comprises adjustment means for adjusting the height thereof relative to said front subframe.

21. An exercise unit as recited in claim 20 wherein said user-engageable leg exercise member comprises a generally L-shaped member which is pivotally attached to said pivot unit and has a depending leg lift arm, a forwardly extending leg curl arm, and ankle engaging means at the distal ends of each of said arms.

22. An exercise unit comprising a frame including upright guide means; a liftable weight assembly including a guided carriage and at least one selectively engageable weight attached thereto guided by said guide means; pulley means including a carriage pulley movable with said carriage and an upper pulley at a fixed location above said carriage for facilitating and directing movement of a cable; a user-engageable cable operatively coupled to said weight assembly and said pulley means for lifting the weight assembly; the improvement and effort level selection means for selectively varying the mechanical advantage of said cable and pulley means, said effort level selection means comprising cable coupling means for coupling one end of said cable directly to said carriage with said cable trained over said upper pulley for requiring a lifting force equal to the selected weight on said guided carriage, and wherein said effort selection means further comprises elevated anchoring means for anchoring said one end of said cable at an elevated location with said cable trained around said carriage pulley and said upper pulley for reducing the required lifting force.

23. An exercise unit according to claim 22 wherein said upper pulley is attached to said frame, and said elevated anchoring location is on said frame adjacent said upper pulley.

24. In an arm curl exercise attachment for the front end of an exercise bench, having a support member removably attachable to a front leg support assembly of the bench and a forwardly facing and inclined arm curl cushion fixed to the support member for supporting the upper arms and elbows of a forwardly facing user seated on the bench, the improvement comprising cable guide means including a forwardly projecting guide arm fixed to said support member, said guide arm projecting forwardly beyond the forward vertical plane of said inclined arm curl cushion fixed to said support member, a roller rotatably supported by said guide arm and a cable guide adjacent the front end of said guide arm for guiding a user-engageable tensioned cable.

25. In an arm curl exerciser having a bench with a frame and a seat supported thereon, a support member attached to the bench frame adjacent the front end of the bench, and a forwardly facing and inclined arm curl cushion fixed to the support member above the horizontal plane of said seat for supporting the upper arms and elbows of a forwardly facing user seated on the bench, the improvement comprising:

a bench frame-mounted cable guide attached to said frame adjacent the front end of said bench and below said seat for guiding a user-engageable tensioned cable; and cable guide means including a forwardly projecting guide arm fixed to said support member, said guide arm projecting forwardly beyond the forward vertical plane of said inclined arm curl cushion fixed to said support member, and an arm-mounted cable guide adjacent the front end of said guide arm for guiding said cable.

26. An exerciser according to claim 25 wherein said arm-mounted cable guide comprises a roller rotatably supported by said guide arm, and a cable retainer fixed to said guide arm and extending forwardly of said roller to define therewith a captive guideway for said cable.

27. In an exercise unit having a frame including upright guide means, a liftable weight assembly guided by said guide means, and a handlebar assembly removably connected to said liftable weight assembly, said handlebar assembly having spaced, longitudinally aligned hand grip portions the improvement comprising:

a cross-piece removably fastened to and extending between said spaced, longitudinally aligned hand grip portions on said handlebar assembly, said cross-piece rotatable about said hand grip portions.

28. An exercise unit according to claim 27 wherein said handlebar assembly is generally Y-shaped having a first portion removably connected to said liftable weight assembly and two arms diverging from said first position; said spaced hand grips extending from said arms.

29. An exercise unit according to claim 27 wherein said cross-piece comprises a connecting loop fixed to each end of said cross-piece, one of said connecting loops partially encircling each of said hand grips so that said cross-piece is rotable about said hand grips.

30. An exercise unit according to claim 29 wherein said cross-piece is rotatable about said hand grips between a location adjacent a bottom surface of said arms to a location adjacent a top surface of said arms.

* * * * *

UNITED STATES PATENT AND TRADEMARK OFFICE

CERTIFICATE OF CORRECTION

PATENT NO. : 4,634,127

DATED : January 6, 1987

INVENTOR(S) : Gary L. Rockwell

It is certified that error appears in the above-identified patent and that said Letters Patent is hereby corrected as shown below:

On the title page in the section entitled "OTHER PUBLICATIONS", change "Sorts" to --Sports--.

Col. 9, In claim 1, line 68, change "assembly" to --member--.

Col. 10, In claim 1, line 1, before "rear" insert --said--.

Col. 10, In claim 1, line 7, after "leg" insert --assembly--.

Col. 10, In claim 8, line 62, change "1" to --7--.

Signed and Sealed this

Sixteenth Day of August, 1988

*Attest:*

DONALD J. QUIGG

*Attesting Officer*

*Commissioner of Patents and Trademarks*